US005984013A

United States Patent [19]

Giacomino et al.

[11] Patent Number: 5,984,013

[45] Date of Patent: Nov. 16, 1999

[54] PLUNGER ARRIVAL TARGET TIME ADJUSTMENT METHOD USING BOTH A AND B VALVE OPEN TIMES

[76] Inventors: Jeff L. Giacomino; Bruce M. Victor, both of 1762 Denver Ave., Fort Lupton, Colo. 80621

[21] Appl. No.: 09/082,458

[22] Filed: May 20, 1998

Related U.S. Application Data

[60] Provisional application No. 60/047,471, May 23, 1997.

[51] Int. Cl.[6] ..... E21B 43/12

[52] U.S. Cl. ..... 166/373; 166/53

[58] Field of Search ..... 166/53, 372, 373, 166/374

[56] References Cited

U.S. PATENT DOCUMENTS

| | | | |
|---|---|---|---|
| 5,132,904 | 7/1992 | Lamp | 166/53 X |
| 5,146,991 | 9/1992 | Rogers, Jr. | 166/369 |
| 5,314,016 | 5/1994 | Dunham | 166/250 |
| 5,526,883 | 6/1996 | Breaux | 166/373 |
| 5,826,659 | 10/1998 | Hershberger | 166/372 |
| 5,878,817 | 3/1999 | Stastka | 166/372 |

*Primary Examiner*—Frank Tsay
*Attorney, Agent, or Firm*—Flanagan & Flanagan; John R. Flanagan; John K. Flanagan

[57] ABSTRACT

A plunger arrival target time adjustment method for use in conjunction with a gas-producing well includes the steps of setting times of A valve open and close states, setting times of B valve open and close states where the time of B valve open state occurs separately from and in succession after the time of A valve open state, setting a target time for arrival of a plunger starting with opening of the well upon converting the A valve to the open state and ending with sensing of arrival of the plunger at an upper terminal position of the well, measuring travel time of the plunger from the opening of the well to the sensing of plunger arrival irrespective of whether the arrival occurs during the time of A valve open state or the time of B valve open state, and setting a new target time for plunger arrival based on a predetermined relationship of the measured plunger arrival travel time to the previously set plunger arrival target time.

16 Claims, 14 Drawing Sheets

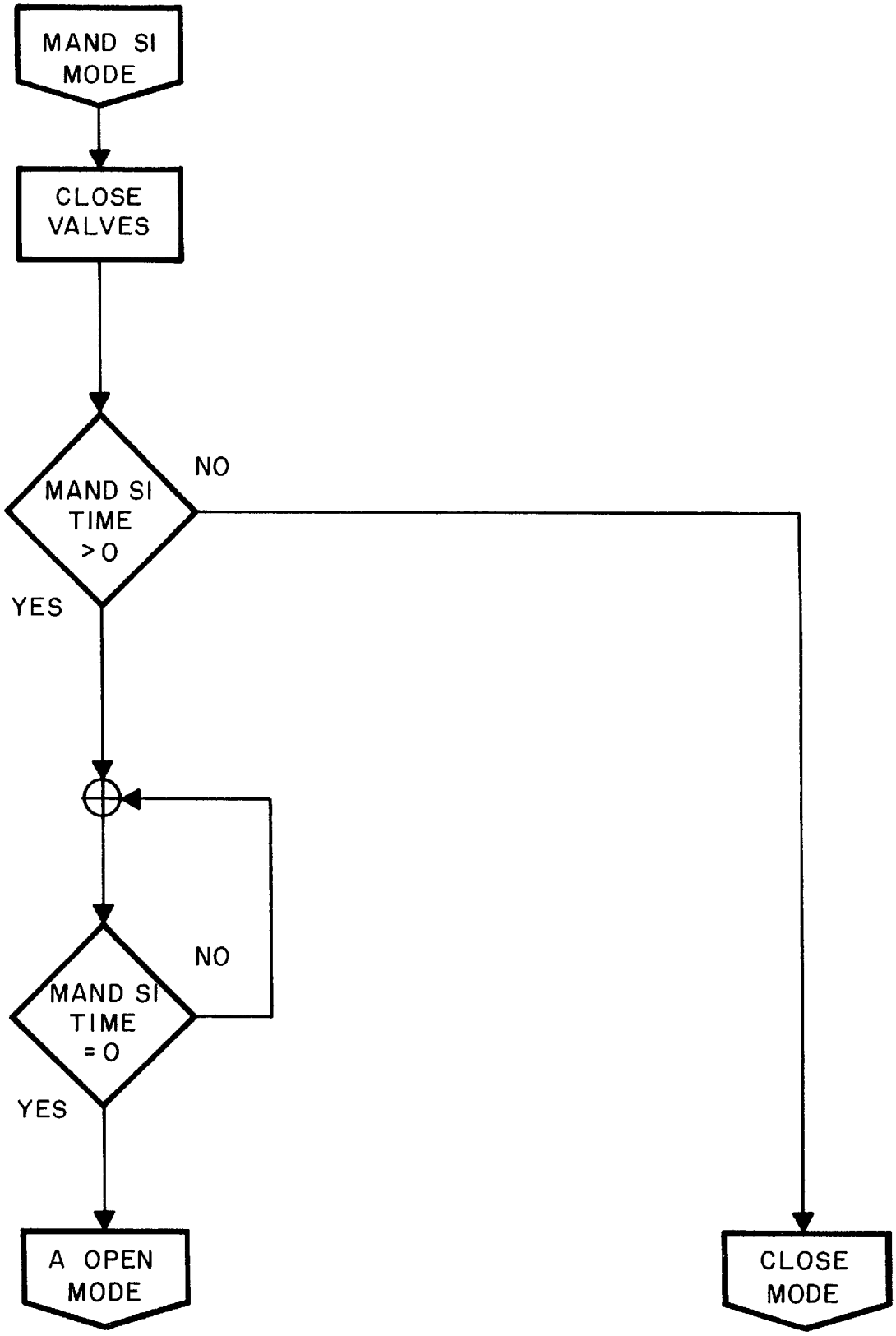
(FIG. 6) FIG. 8 (FIG. 5)

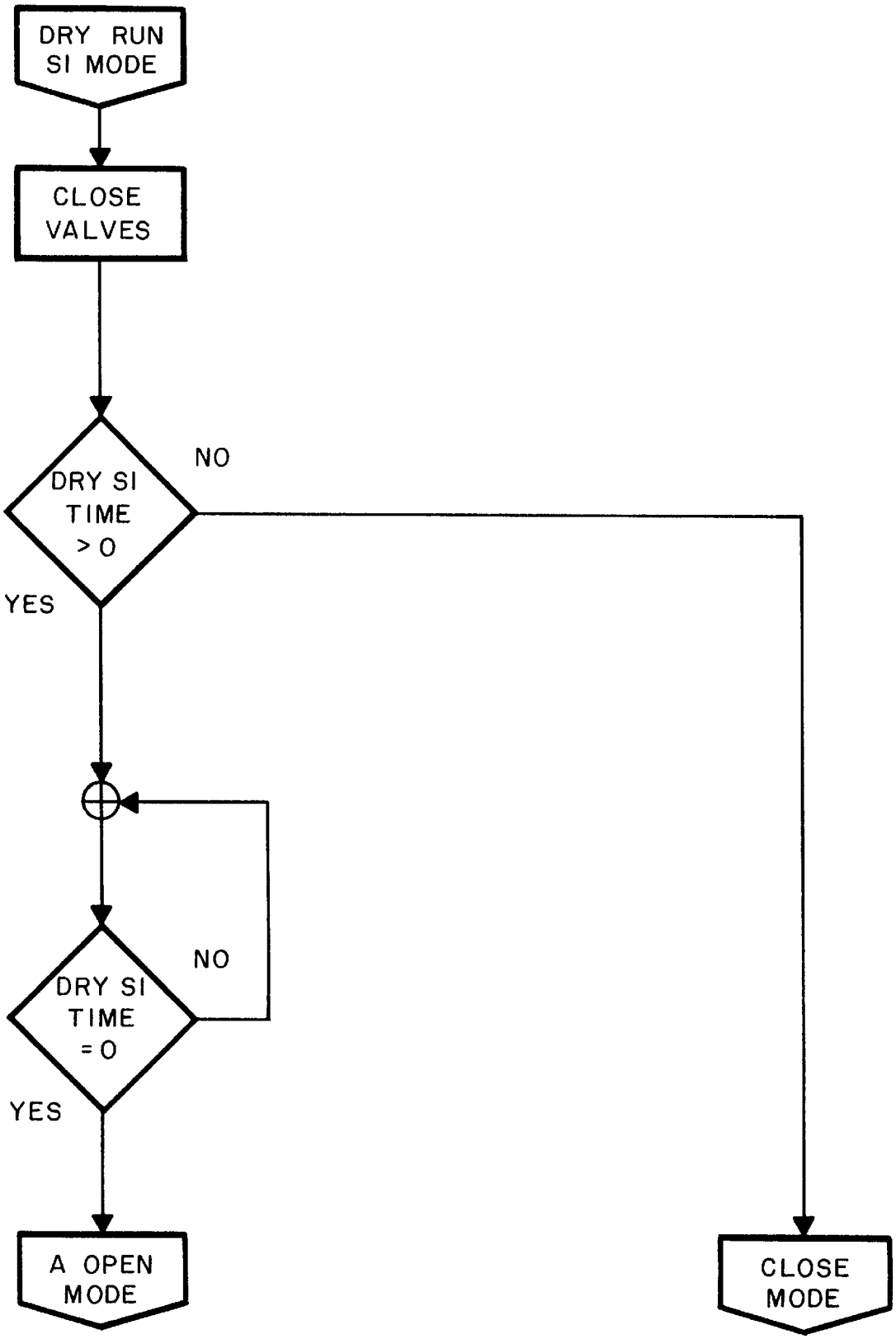
(FIG. 6) FIG. 9 (FIG. 5)

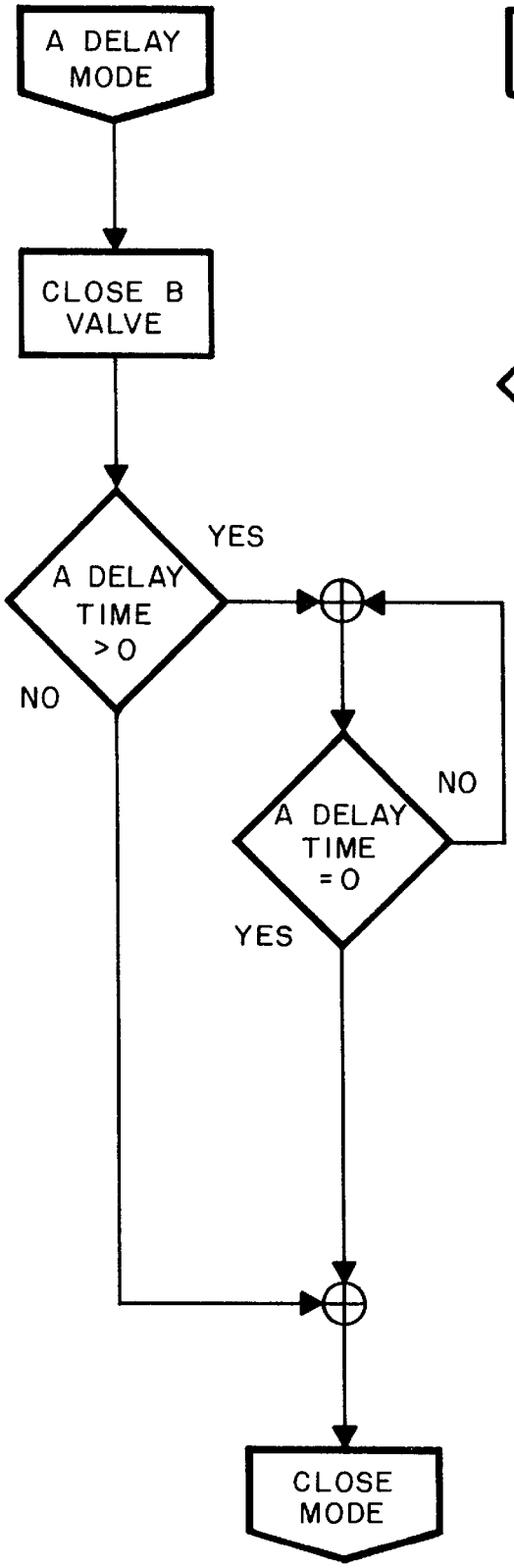
FIG. 10 (FIG. 5)
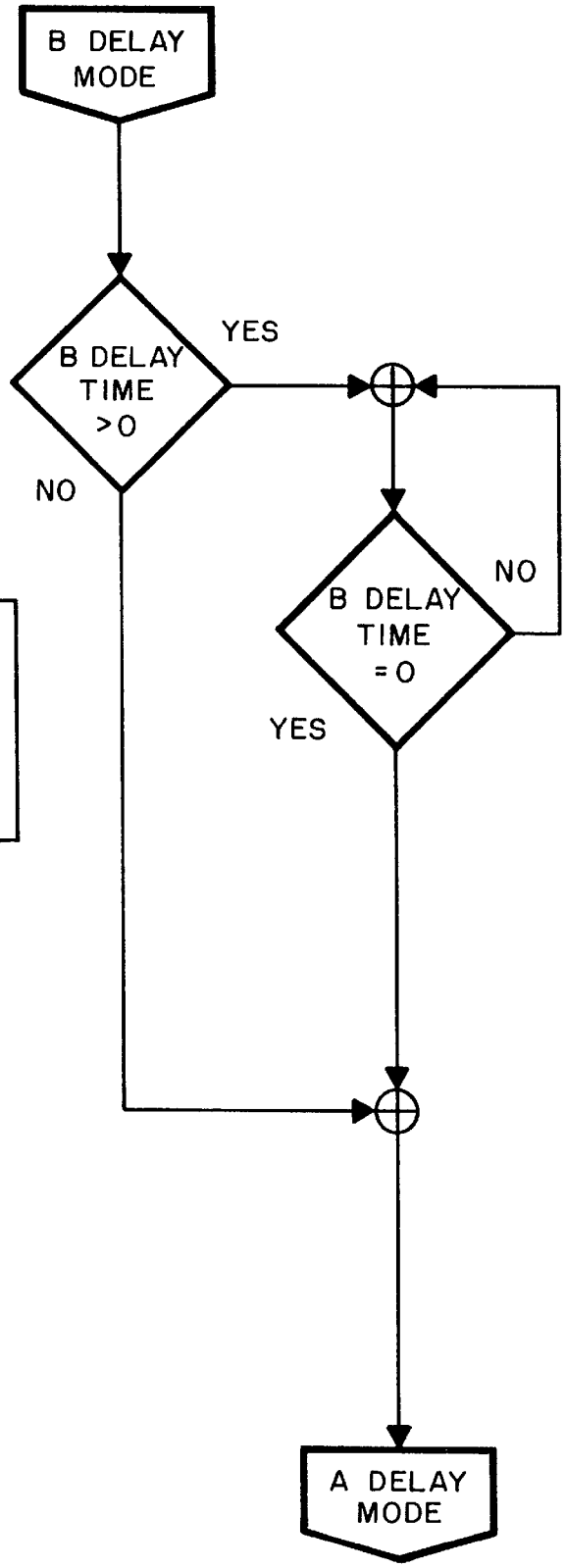
FIG. 11 (FIG. 10)

ADJUST TIMES 1
DRY RUN?
NO
YES
> 2.5* TARGET TIME
NO
YES
DECREMENT DRY RUN COUNT
X-SLOW DELAY
NO
YES
DRY RUN COUNT=0
NO
YES
DRY RUN SI MODE
A DELAY MODE
CLOSE MODE
ADJUST TIMES 2
(FIG. 9)
(FIG. 10)
(FIG. 5)
(FIG. 13)

PLUNGER ARRIVAL TARGET TIME ADJUSTMENT METHOD USING BOTH A AND B VALVE OPEN TIMES

This application claims the benefit of U.S. provisional application No. 60/047,471, filed May 23, 1997.

BACKGROUND OF THE INVENTION

1. Field of the Invention

The present invention generally relates to plunger lift technology and, more particular, is concerned with a plunger arrival target time adjustment method using both A and B valve open times.

2. Description of the Prior Art

In a typical prior art plunger lift system, such as seen in FIG. 1, a gas-producing well W employs a freely movable plunger P disposed within a tubing string T in the well that is capable of traveling vertically in the tubing string T as the well W is cycled between shut-in and open conditions. The well W is shut-in for an interval during which the pressure of gas G gradually elevates within the well casing C. When the pressure of gas G reaches a desired level, a master gas flow control valve A, commonly referred to as the A valve, is opened causing the plunger P to be propelled by the accumulated gas pressure from a lower initial position, at a bottom bumper B, upward in the tubing string T toward an upper terminal position adjacent to a plunger arrival sensor S. Liquid, such as water F, and gas G above the plunger P discharges from the well W through a horizontal conduit H into a flow line L, called a gas sales line, leading to a separator (not shown). At the separator, gas and water separate from one another and are routed to separate storage vessels. The plunger P is held at the upper terminal position until the gas pressure diminishes to an extent permitting the plunger P to fall under gravity to its lower initial position.

Many plunger lift systems, in addition to the master flow control or A valve, will typically utilize a second flow control valve, commonly referred to in the industry as the B valve and an electronic controller E to control cycling of the well between shut-in and open times and thereby the production of gas from the well. As mentioned above, the A valve is interposed in the gas sales line L. The B valve is interposed in a vent line that leads to a containment tank or pit or sometimes directly to atmosphere. The gas sales line L is under a higher pressure than the vent line. The shut-in and open times of the cycles providing optimum well production will vary from well to well. The electronic controller E is programmed to set and control the times of opening and closing of the A and B valves as well as other functions to provide for optimum production at a given well. Also, the plunger lift system typically employs the arrival sensor S at the wellhead to sense the arrival of the plunger P at the upper terminal position. The arrival sensor S sends an electrical signal to the electronic controller E in response to the arrival of the plunger P.

The employment of the B valve is necessary on many wells due to pressure fluctuations experienced in the high pressure gas sales line L of such wells which can impede efficient production of gas G from the well W. There are various causes of pressure variation, the main ones being conditions created by mechanical equipment attached to the gas sales line L or the weather. When gas sales line pressure fluctuates enough that it becomes too great for the well casing pressure to exceed it and drive the plunger P to the upper terminal position of the wellhead, the plunger P may stall before reaching the surface or not arrive at the upper terminal position within the preset open time of the A valve. The electronic controller E is programmed to then close the A valve and open the B valve to vent the well casing C to atmosphere or a low pressure tank or pit and thereby permit the plunger P to reach the upper terminal position and blow out the fluid that has accumulated above the plunger P. After the plunger P arrives and blows out the fluid, the electronic controller E will shut the B valve and open the A valve and thus commence sale of gas from the well W through the A valve and the gas sales line L.

Heretofore, electronic controllers have been programmed to set an initial A-valve open time and then to adjust the A-valve open time in order to reach a time value which optimizes production and sales of gas from the well. These adjustments are made by the electronic controller following a programmed sequence of steps that use only the past consecutive readings of the plunger arrival times which fall during A-valve open times. In some instances it may take the electronic controller from a few hours to many days to make the incremental changes necessary to optimize well shut-in and open cycle times for optimized production and sales of gas from the well. Should the plunger P fail just once to arrive at the upper terminal position of the wellhead within the assigned A-valve open time as the electronic controller is proceeding through its programmed optimization sequence or after completion thereof, the electronic controller is programmed to treat this event as a plunger arrival failure even through the plunger does subsequently arrive during the B-valve open time after the system has closed the A valve and opened the B valve.

In response to the noted plunger arrival failure, the electronic controller is programmed to return to its initial preset or programmed A-valve open time and begin the programmed optimization sequence over again. This results in a loss of the time, in terms of hours or days, which was spent to reach the optimized A-valve open time in the first place which adversely affects the efficiency of gas production and sales being made from the well.

Consequently, a need exists for improvement of the programmed optimization sequence for setting A-valve open time to improve control of cycling of the well between shut-in and open times and thereby improve the efficiency of gas production and sales from the well.

SUMMARY OF THE INVENTION

The present invention provides a plunger arrival target time adjustment method for gas-producing wells designed to satisfy the aforementioned need. The adjustment method of the present invention uses both A and B valve open times in adjusting the plunger arrival target time to provide optimization of gas production and sales from the well without first returning to the initial preset values should plunger arrival occur after expiration of A-valve open time and during B-valve open time.

Accordingly, the present invention is directed to a plunger arrival target time adjustment method for use in conjunction with a gas-producing well, a freely movable plunger disposed in the well for traveling vertically relative to the well between a lower initial position and an upper terminal position in response to open and shut-in conditions of the well, a sales line connected in flow communication with the well and containing a gas under a first level of pressure, a vent line connected in flow communication with the well and containing a gas under a second level of pressure less than the first level of pressure of the gas in the sales line, an A valve interposed in the sales line and being convertable between open and close states in which flow of gas is correspondingly allowed and blocked from the well to the sales line, a B valve interposed in the vent line and being convertable between open and close states in which flow of gas is correspondingly allowed and blocked from the well to the vent line, a plunger arrival sensor disposed remote from the lower initial position of the plunger and adjacent to the upper terminal position of the plunger for sensing arrival of the plunger at the upper terminal position, and an electronic controller connected to the plunger arrival sensor and the A and B valves for controlling cycling of the A and B valves between open and close states and thereby the well between open and shut-in conditions in which the plunger is allowed to travel correspondingly upwardly to the upper terminal position and downwardly to the lower initial position and gas to correspondingly flow from the well and elevate in pressure in the well to a level above the first level of pressure of the gas sales line.

The plunger arrival target time adjustment method comprises the steps of: (a) setting times of A valve open and close states; (b) setting times of B valve open and close states, the time of B valve open state to occur separately from and in succession to the time of A valve open state; (c) setting a target time for plunger arrival starting with opening of the well upon converting the A valve to the open state and ending with the sensing of arrival of the plunger at the upper terminal position of the well; (d) measuring travel time of the plunger from the opening of the well to the sensing of plunger arrival irrespective of whether the arrival occurs during the time of A valve open state or the time of B valve open state; and (e) setting a new target time for plunger arrival based on a predetermined relationship of the measured plunger arrival travel time to the previously set plunger arrival target time. The predetermined relationship involves incrementing the previously set target time by a preset time interval in response to occurrence of a preset number of plunger arrivals within a preset percentage of the previously set plunger arrival target time. More particularly, the previously set target time is incremented by a time interval of about 30 seconds when there occurs a preset number of consecutive measured plunger arrival travel times within about 5% of the previously set target time.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIGS. 5 to 16 taken together are a flow diagram representing the steps of a software program run by the electronic controller of FIG. 2 which includes the steps performed in carrying out the method of the present invention.

DETAILED DESCRIPTION OF THE INVENTION

Figure 1:
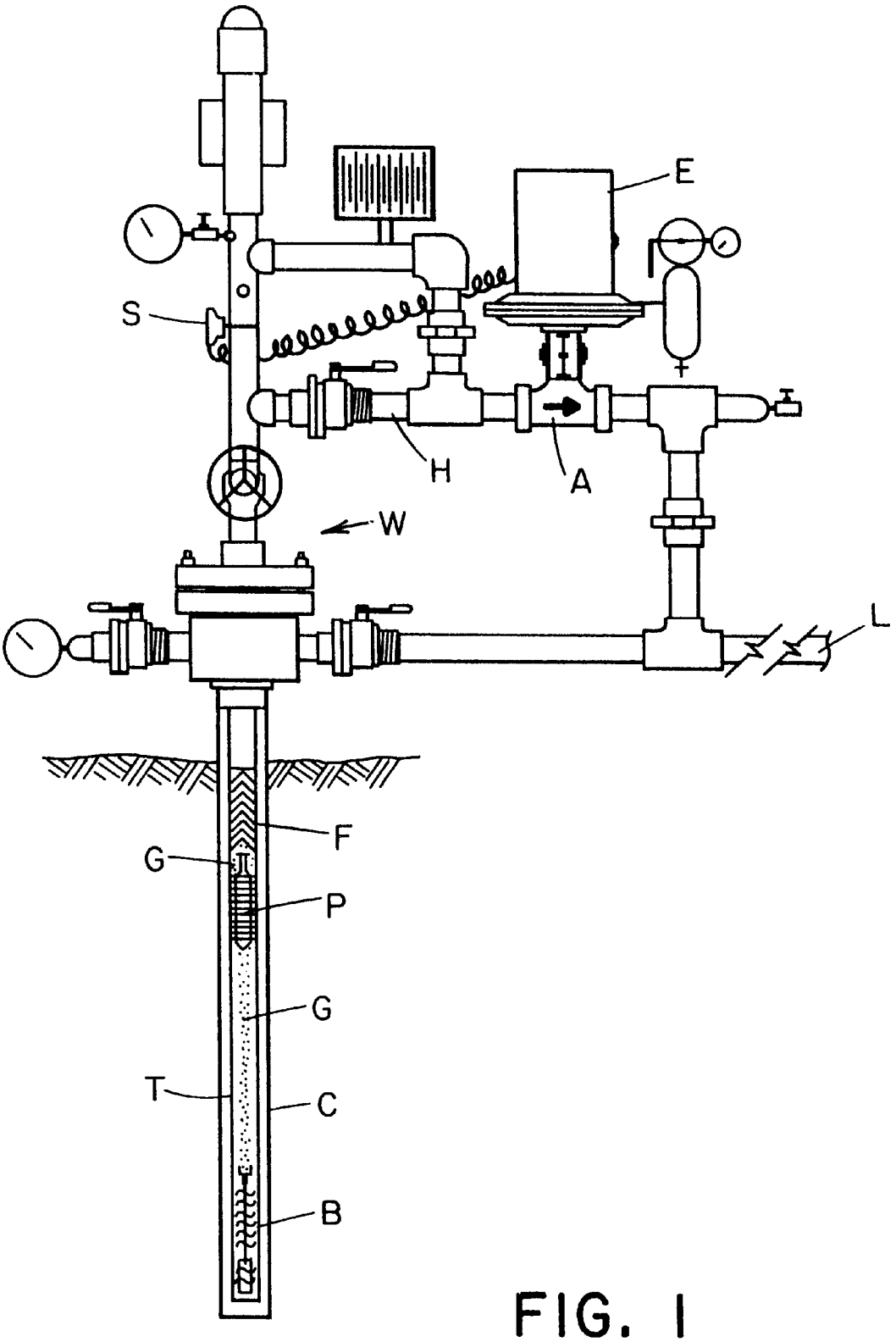
FIG. 1 (PRIOR ART)
FIG. 1 is a diagrammatic view of a prior art plunger lift system which can employ the plunger arrival target time adjustment method of the present invention.
Figure 2:
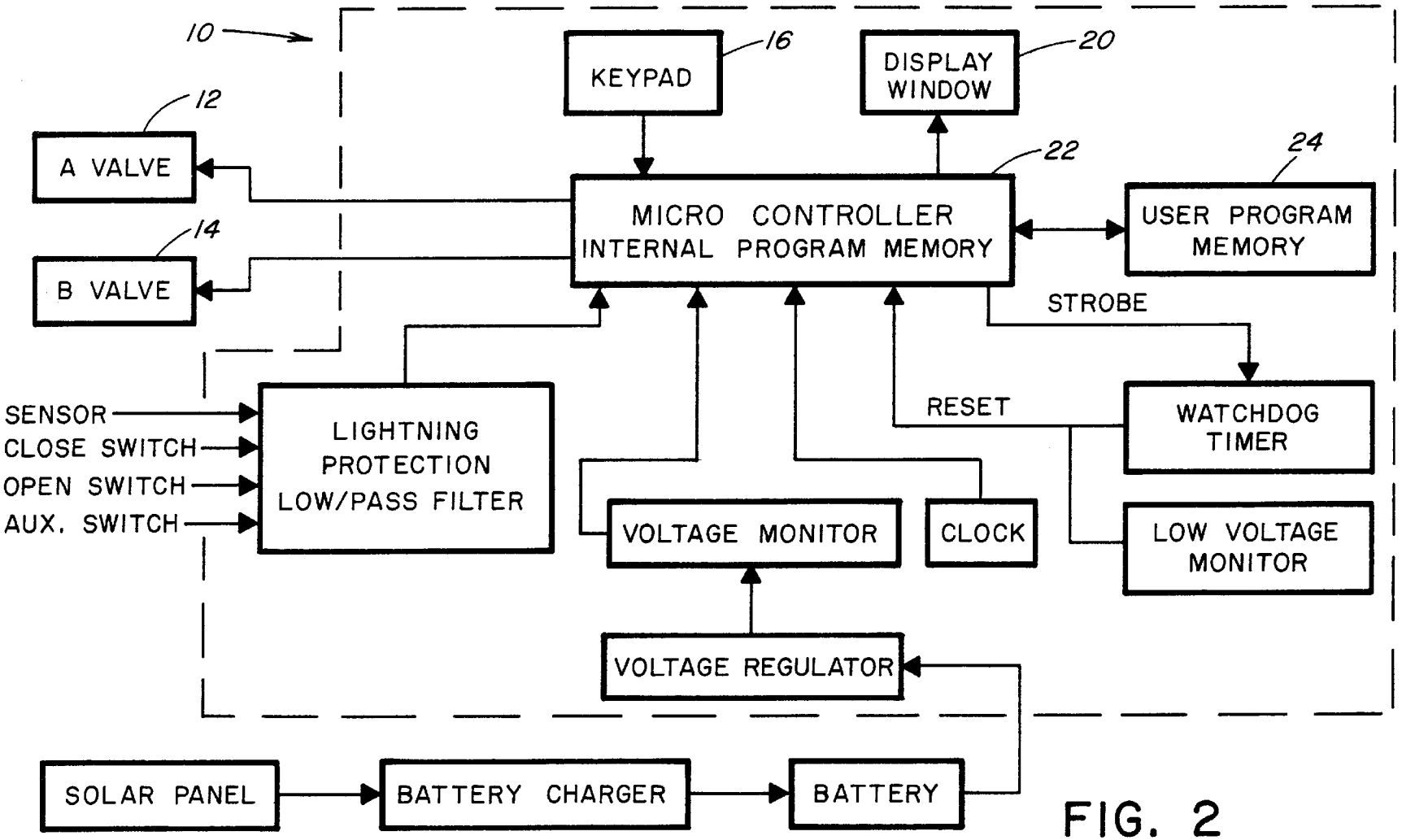
FIG. 2 is a block diagram of an electronic controller connected to A and B valves and programmed to operate in accordance with the plunger arrival target time adjustment method of the present invention.

Referring to the drawings and particularly to FIG. 2, there is depicted a block diagram of a conventional electronic controller, generally designated 10, which is connected to conventional A and B valves 12, 14 of a prior art plunger lift system, such as the one shown in FIG. 1. The electronic controller 10 is programmed to operate in accordance with a plunger arrival target time adjustment method of the present invention to reset and adjust automatically the open, or flow, and shut-in times of the plunger lift operated gas-producing well W to maximize the efficiency of gas production from the well.

Figure 4:
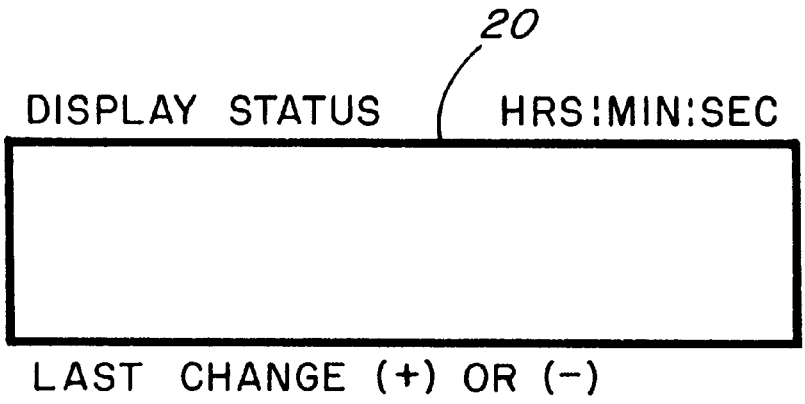
FIG. 4 is a plan diagram of a display window on the conrtroller of FIG. 2.
Figure 3:
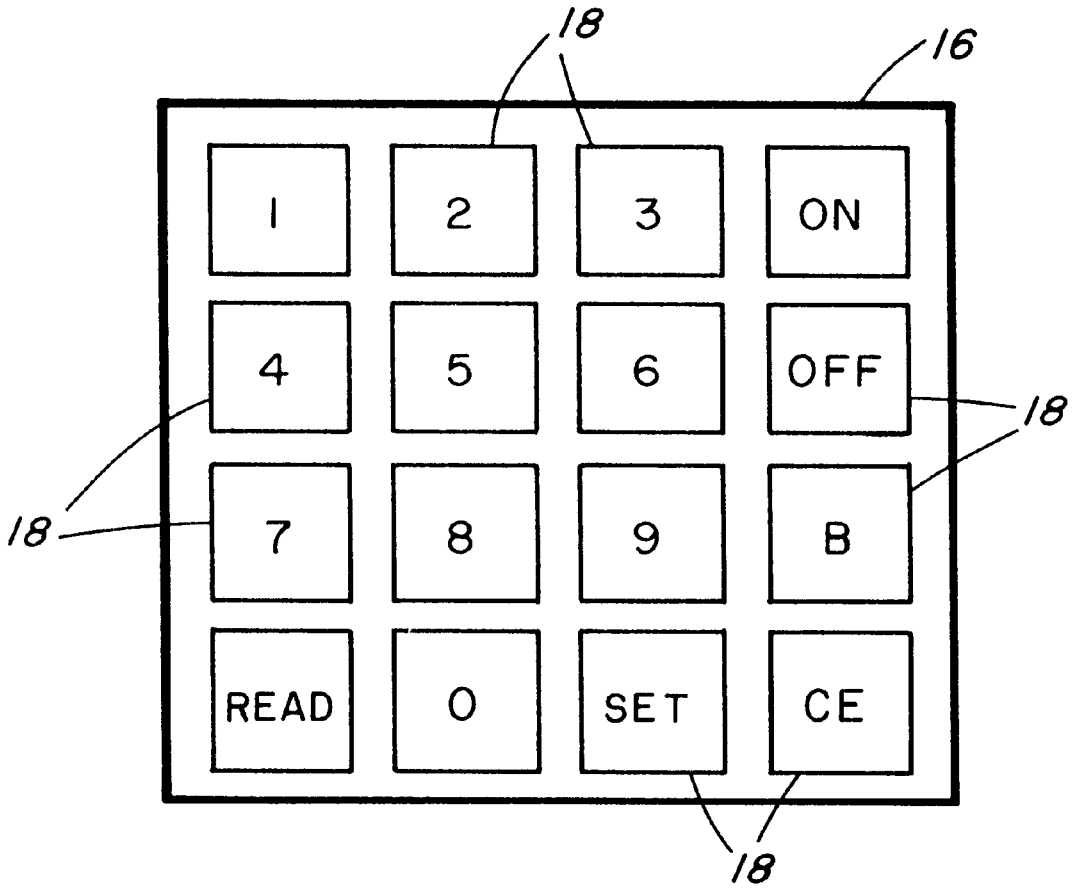
FIG. 3 is a plan diagram of a keypad on the controller of FIG. 2.

Referring now to FIGS. 2 to 4, the electronic controller 10 includes a keypad 16 having sixteen keyswitches 18 that are assigned numbers 0, 1, 2, 3, 4, 5, 6, 7, 8 and 9 and parameters ON, OFF, READ, SET, CE and B. The electronic controller 10 further includes a display window 20 and a micro controller 22 interfaced with the A and B valves 12, 14, keypad 16 and display window 20 as well as the other components illustrated in FIG. 2 which are not necessary to discuss herein for the reader to gain a thorough and complete understanding of the adjustment method of the present invention. The micro controller 22 has an internal program memory for receiving and executing instructions and outputting commands and values. The electronic controller 10 also includes an external user program memory 24, such as a ROM or PROM, interfaced with the micro controller 22. A software program resides in the external user memory 24 that controls the operation of the electronic controller 10 in carrying out the plunger arrival target time adjustment method of the present invention. The software program is executed by the micro controller 22 in accordance with instructions and values inputted or programmed into the internal program memory of the micro controller 22 by an operator using the keypad 16 for efficiently operating the well to achieve maximized gas production.

Tables I and II list the various menu options or selections that can be made by the operator for keying instructions and values into and reading values from the electronic controller 10. Table I lists in the first column the menu selections for displaying the current settings correspondingly listed in the second column.

TABLE I

| | |
|---|---|
| READ 00 | Display Battery Status |
| READ 01 | Display Current Operating Mode |
| READ 02 | Display A Delay Time |
| READ 03 | Display Mandatory Shut-In Time/Fast Shut-In Time |
| READ 04 | Display A Valve & Plunger Counts |
| READ 05 | Display Dry Run Shut-In Time And Count |
| READ 06 | Display Last 10 Plunger Arrival Times |
| READ 07 | Display A Valve Total Open Time |
| READ 08 | Display Well Synchronization Mode |
| READ 09 | Display Sensor Status |
| READ 10 | Display Total Accumulated Counts and Times |
| READ 11 | Display Target Time |
| READ 12 | Display Minimum and Maximum Delay Times |
| READ 13 | Display Minimum and Maximum Close Time |
| READ 14 | Display Maximum Change in Delay Time |
| READ 15 | Display Maximum Change in Close Time |
| READ 16 | Display Target Count Status |
| READ 17 | Display Current Mode |
| READ 18 | Display Inverse Arithmetic Status |
| READ 19 | Display Close/Delay Mode on Slow Trip |
| READ ON | Display A Open Time |
| READ OFF | Display Close Time |
| READ B0 | Display A Valve Status when B Valve Open |
| READ B1 | Display Change on B Arrival Status |

TABLE I-continued

| | |
|---|---|
| READ B2 | Display B Delay Time |
| READ B4 | Display B Valve & Plunger Counts |
| READ B7 | Display B Valve Total Open Time |
| READ B ON | Display B Open Time |
| READ 50 | Review all values that change during operation |
| READ 90 | Review all programmed values |

Table II lists in the first column the menu selections for modifying the current settings correspondingly listed in the second column.

TABLE II

| | |
|---|---|
| SET 01 | Clear A & B Valve & Plunger Counts & Total Open Times |
| SET 02 | Set A Delay Time |
| SET 03 | Set Mandatory Shut-In Time/Fast Shut-In Time |
| SET 04 | Set A Valve & Plunger Counts |
| SET 05 | Set Dry Run Time and Counts |
| SET 07 | Zero Total A Valve Open Time |
| SET 08 | Enable/Disable Synchronization |
| SET 09 | Enable/Disable Sensor |
| SET 10 | Clear Accumulated Times & Counts |
| SET 11 | Set Target Time |
| SET 12 | Set Minimum & Maximum Delay Time |
| SET 13 | Set Minimum & Maximum Close Time |
| SET 14 | Set Maximum Change in Delay Time |
| SET 15 | Set Maximum Change in Close Time |
| SET 16 | Clear Target Count Status |
| SET 17 | Set Operational Mode |
| SET 18 | Enable/Disable Inverse Arithmetic |
| SET 19 | Select Delay/Close Mode on Slow Trip |
| SET ON | Set A Open Time |
| SET OFF | Set Close Time |
| SET B0 | Enable/Disable A Valve Open with B Valve Open |
| SET B1 | Enable/Disable Adjust Times on B Arrival |
| SET B2 | Set B Delay Time |
| SET B4 | Set B Valve & Plunger Counts |
| SET B7 | Zero Total B Valve Open Time |
| SET B ON | Set B Open Time |
| SET 50 | Shut in well at end of current Open cycle & Enable Auto-Catcher |
| SET 90 | Program all values |

When the electronic controller 10 is running in an Auto mode in which it will automatically adjust the open and shut-in times of the well, it expects the Travel Time of the plunger P from the time the A valve is opened until the time the plunger P arrives at the surface (the upper terminal position of the wellhead) to match an initial programmed Target Time. The operator will select a Target Time based on the depth of the well and the operating conditions. The electronic controller 10 can run with a fixed Target Time or it can calculate a new, or floating, Target Time based on the past history of plunger Travel Times. When a floating Target Time is selected, in accordance with the plunger arrival target time adjustment method of the present invention the Target Time will be incremented by a preset time interval, such as 30 seconds, when there are a selected number (or Counts) of consecutive Travel Times within 5% of the Target Time. To prevent the Target Time from becoming unreasonably large, the new Target Time will not increase past 150% of the originally preset or programmed Target Time.

The operating conditions in the well W and their impact on the plunger speed will cause the plunger P to make one of eight general types of runs as follows:

1. Dry Run

The plunger P arrives at the surface so quickly (the Travel Time is faster than or equal to the programmed Dry Run Time) that there is probably no liquid in the tubing string T. If this occurs more than the programmed number (or Counts) of consecutive times, then the controller goes to the Dry Run Shut-In Mode and no changes are made to adjust the Target Time.

2. Extra-Fast Run

The plunger P arrives at the surface (the Travel Time is) slower than the Dry Run Time but in less than one-half the Target Time. This results in the Maximum Change in Delay Time being added to the current programmed A Delay Time and the Maximum Change in Close Time being subtracted from the current programmed A Close Time.

3. Fast Run

The plunger P arrives at the surface in a Travel Time that is more than one-half the Target Time, but less than 95% of the Target Time. This results in a fraction of the Maximum Change in Delay Time being added to the current programmed A Delay Time and a fraction of the Maximum Change in Close Time being subtracted from the current programmed A Close Time.

4. Optimal Run

The plunger P arrives at the surface in a Travel Time that is more than 95% of the Target Time and less than 105% of the Target Time. This results in 5% of the Maximum Change in Delay Time being added to the current programmed A Delay Time and no changes to the current programmed A Close Time.

5. Slow Run

The plunger P arrives at the surface in a Travel Time that is more than 105% of the Target Time, but less than 200% of the Target Time. This results in a fraction of the Maximum Change in Delay Time being subtracted from the current programmed A Delay Time and a fraction of the Maximum Change in Close Time being added to the current programmed A Close Time.

6. Extra-Slow Run

The plunger P arrives at the surface in a Travel Time that is more than 200% of the Target Time, but less than 250% of the Target Time. This results in the Maximum Change in Delay Time being subtracted from the current programmed A Delay Time and the Maximum Change in Close Time being added to the current programmed A Close Time.

7. Too-Slow Run

The plunger P arrives at the surface in a Travel Time that is more than 250% of the Target Time. Depending on the option selected under menu selection SET 19, the electronic controller 10 will either go to the Close mode or to the Delay mode.

8. No Arrival

The plunger P does not arrive at the surface. The electronic controller 10 will go to Mandatory Shut-In mode.

If the Change on B-Arrival mode has been enabled with a menu selection SET B1, the electronic controller 10 will behave identically for any of the Travel Times of the above plunger arrivals irrespective of whether the A or B valve 12, 14 is open in accordance with the target time adjustment method of the present invention.

The operator programs the Minimum and Maximum Delay and Close times for the electronic controller 10. When auto-adjusting the Target Time, the electronic controller 10 will not exceed these values. In normal operation, a plunger Travel Time faster than the Target Time will shorten the Close Time and lengthen the Delay (Sales) Time. A plunger Travel Time slower than the Target Time will lengthen the Close Time and shorten the Delay (Sales) Time. This can be reversed by the operator selecting the Inverse Change mode under a menu selection SET 18.

In accordance with the target time adjustment method of the present invention, the amount of time added and subtracted is a function of the programmed Maximum Change in Delay Time and Maximum Change in Close Time and the difference of the Travel Time from the Target Time. Travel Times close to the Target Time will change the Close and Delay Times less than Travel Times further away from the Target Time.

The following equations define the changes made to the Delay and Close Times in accordance with the target time adjustment method of the present invention for five of the general types of runs discussed above:

Extra-Fast Run: Normal Arithmetic new Delay Time=previous Delay Time+Maximum Change in Delay Time new Close Time=previous Close Time−Maximum Change in Close Time Extra-Fast Run: Inverse Arithmetic new Delay Time=previous Delay Time−Maximum Change in Delay Time new Close Time=previous Close Time+Maximum Change in Close Time Fast Run: Normal Arithmetic new Delay Time=previous Delay Time+[2×(Target Time −Travel Time)÷Target Time]× Maximum Change in Delay Time new Close Time=previous Close Time−[2×(Target Time −Travel Time)÷Target Time]× Maximum Change In Close Time Fast Run: Inverse Arithmetic new Delay Time=previous Delay Time−[2×(Target Time −Travel Time)÷Target Time]× Maximum Change in Delay Time new Close Time=previous Close Time+[2×(Target Time −Travel Time)÷Target Time]× Maximum Change in Close Time Optimal Run: Normal Arithmetic new Delay Time=previous Delay Time+(0.05×Maximum Change in Delay Time) Close Time is not changed.

Optimal Run: Inverse Arithmetic new Delay Time=previous Delay Time−(0.05×Maximum Change in Delay Time) Close Time is not changed.

Slow Run: Normal Arithmetic new Delay Time=previous Delay Time−[(Travel Time−Target Time)÷Target Time]× Maximum Change in Delay Time new Close Time=previous Close Time+[(Travel Time−Target Time)÷Target Time]× Maximum Change in Close Time Slow Run: Inverse Arithmetic new Delay Time=previous Delay Time+[(Travel Time−Target Time)÷Target Time]× Maximum Change in Delay Time new Close Time=previous Close Time−[(Travel Time−Target Time)÷Target Time]× Maximum Change in Close Time Extra-Slow Run: Normal Arithmetic new Delay Time=previous Delay Time−Maximum Change in Delay Time previous Close Time=previous Close Time+Maximum Change in Close Time Extra-Slow Run: Inverse Arithmetic new Delay Time=previous Delay Time+Maximum Change in Delay Time new Close Time=previous Close time−Maximum Change in Close Time FIGS. 5 to 16 taken together depict a flow diagram representing the steps of the software program run by the electronic controller 10. The program includes the steps performed in carrying out the plunger arrival target time adjustment method of the present invention.

Figure 5:
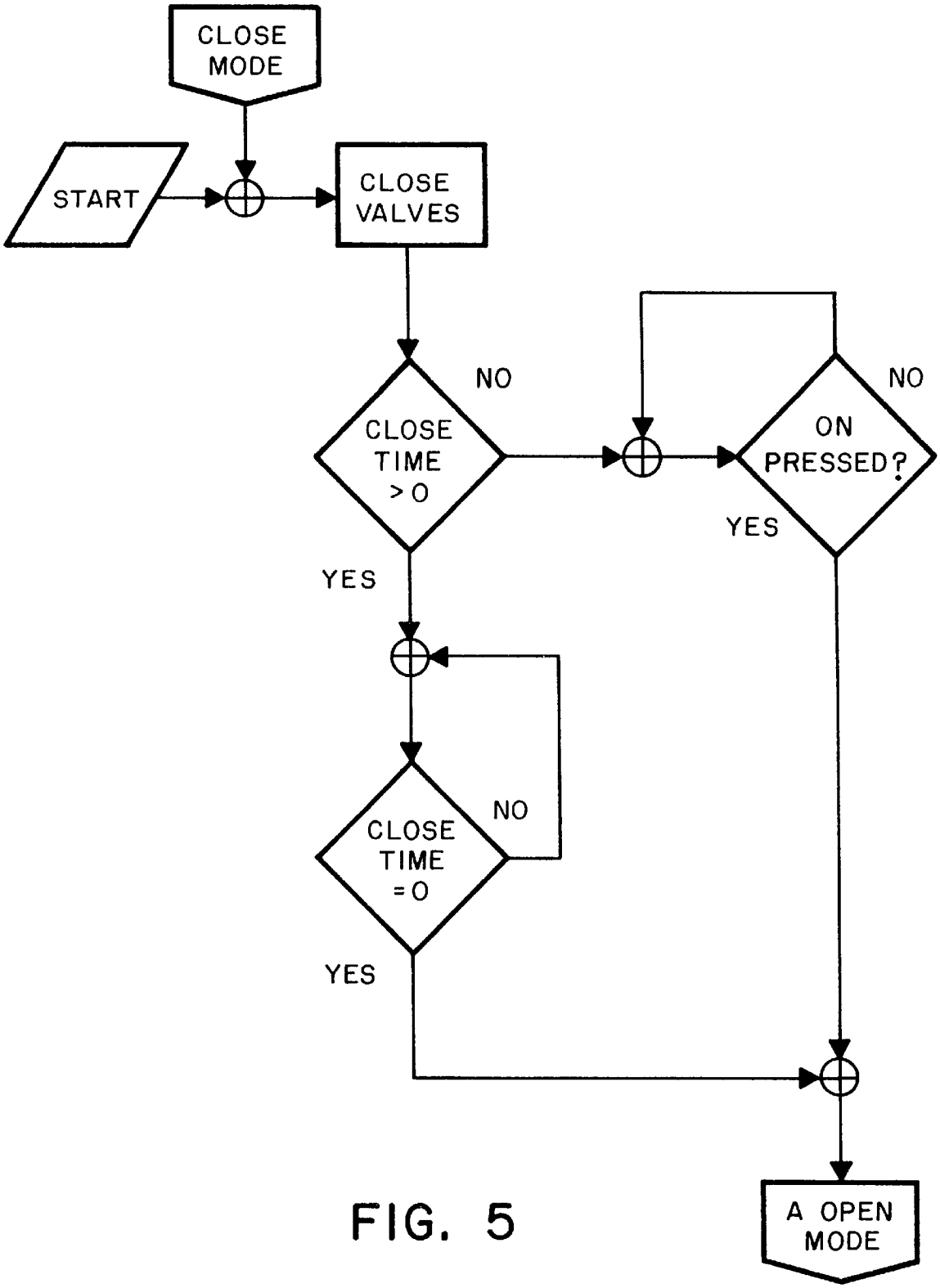
Figure 6:
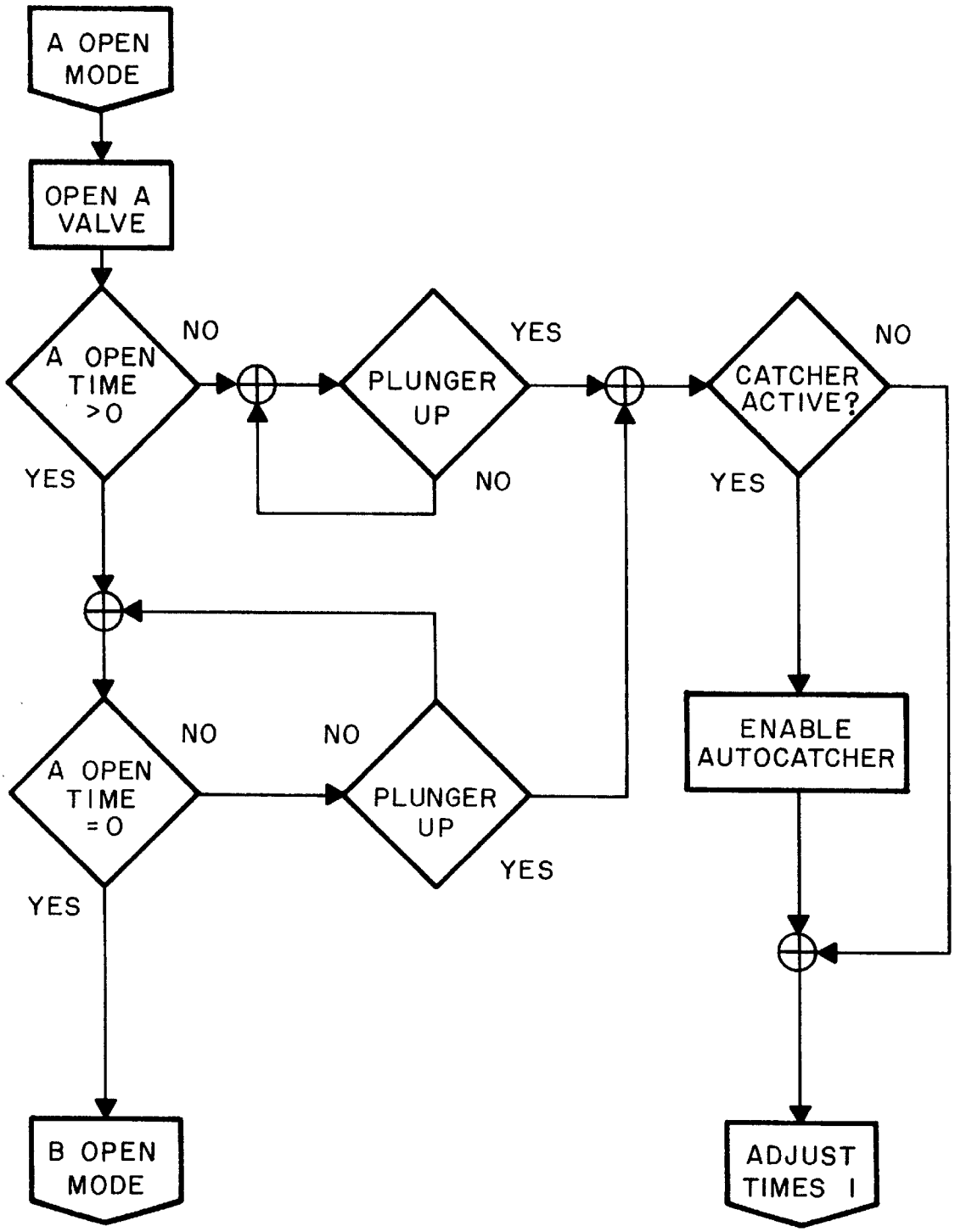

FIG. 5 depicts a Close Mode of the program in which the Close Time programmed for the A valve is monitored and once the Close Time expires, that is, equals zero, the program goes to an A Open Mode (FIG. 6).

Figure 7:
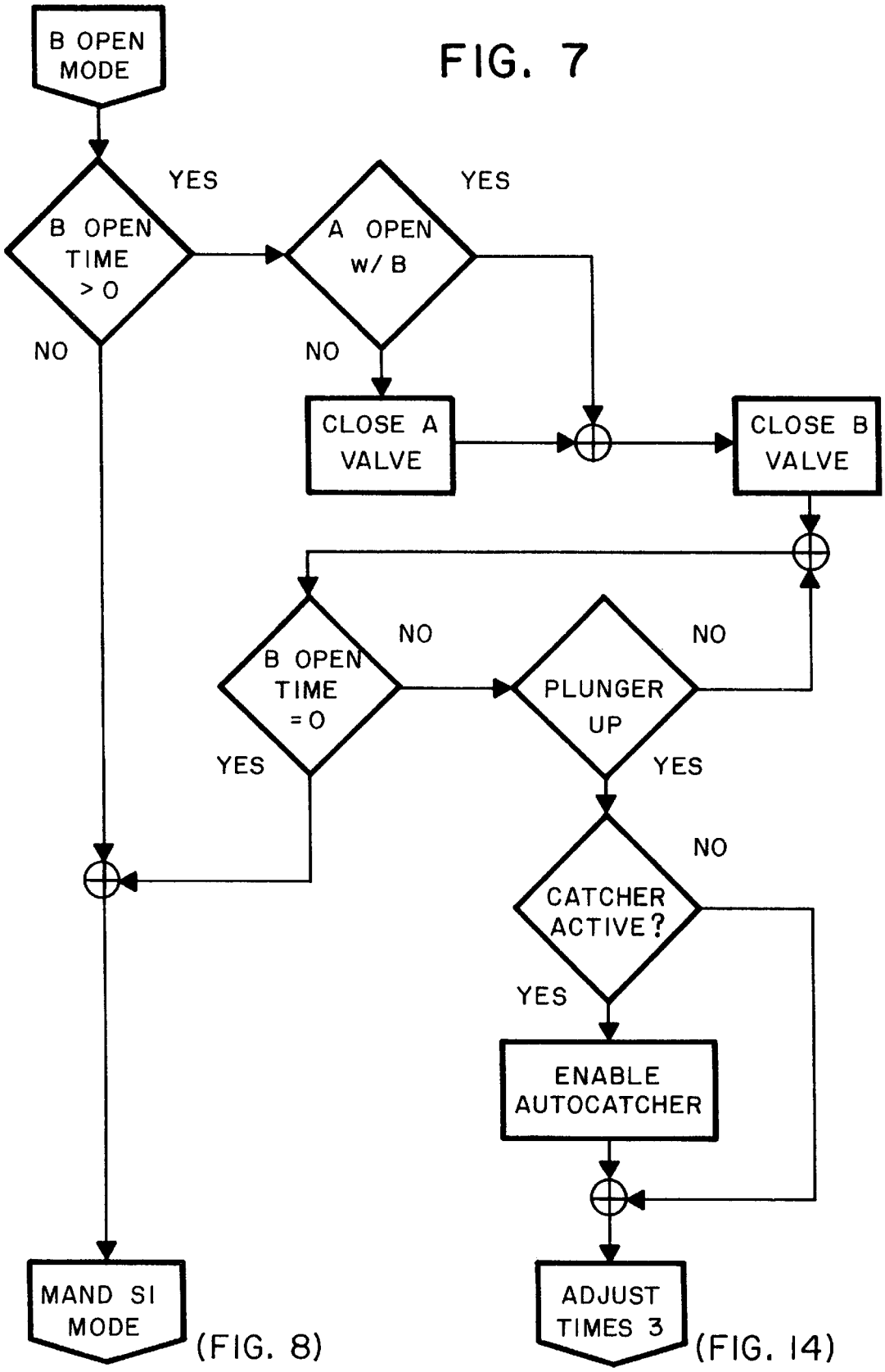
Figure 12:
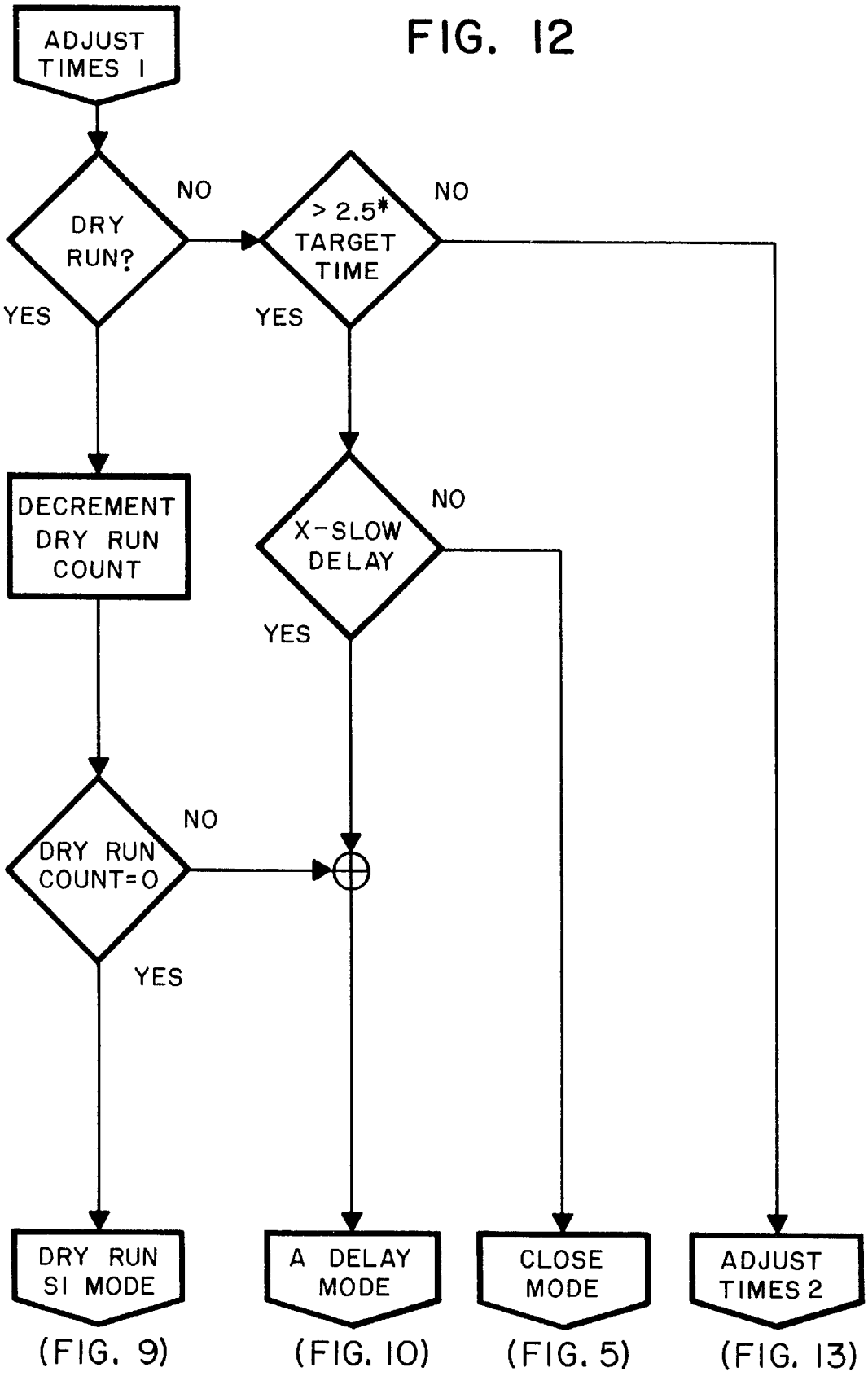

FIG. 6 depicts an A Open Mode of the program in which the A valve is switched from close to open condition and the program loops and awaits the arrival of the plunger P to the "up" or upper terminal position the wellhead. If the plunger P is sensed by the arrival sensor S as being "up" before A Open Time expires or equals zero, then the program goes to an Adjust Times 1 mode (FIG. 12). If the plunger P is not sensed as being "up" when A Open Time expires or equals zero, then the program goes to a B Open Mode (FIG. 7). (The A and B Open Times can be initially set at various points relative to the Target Time setting to accommodate different well conditions.)

Figure 14:
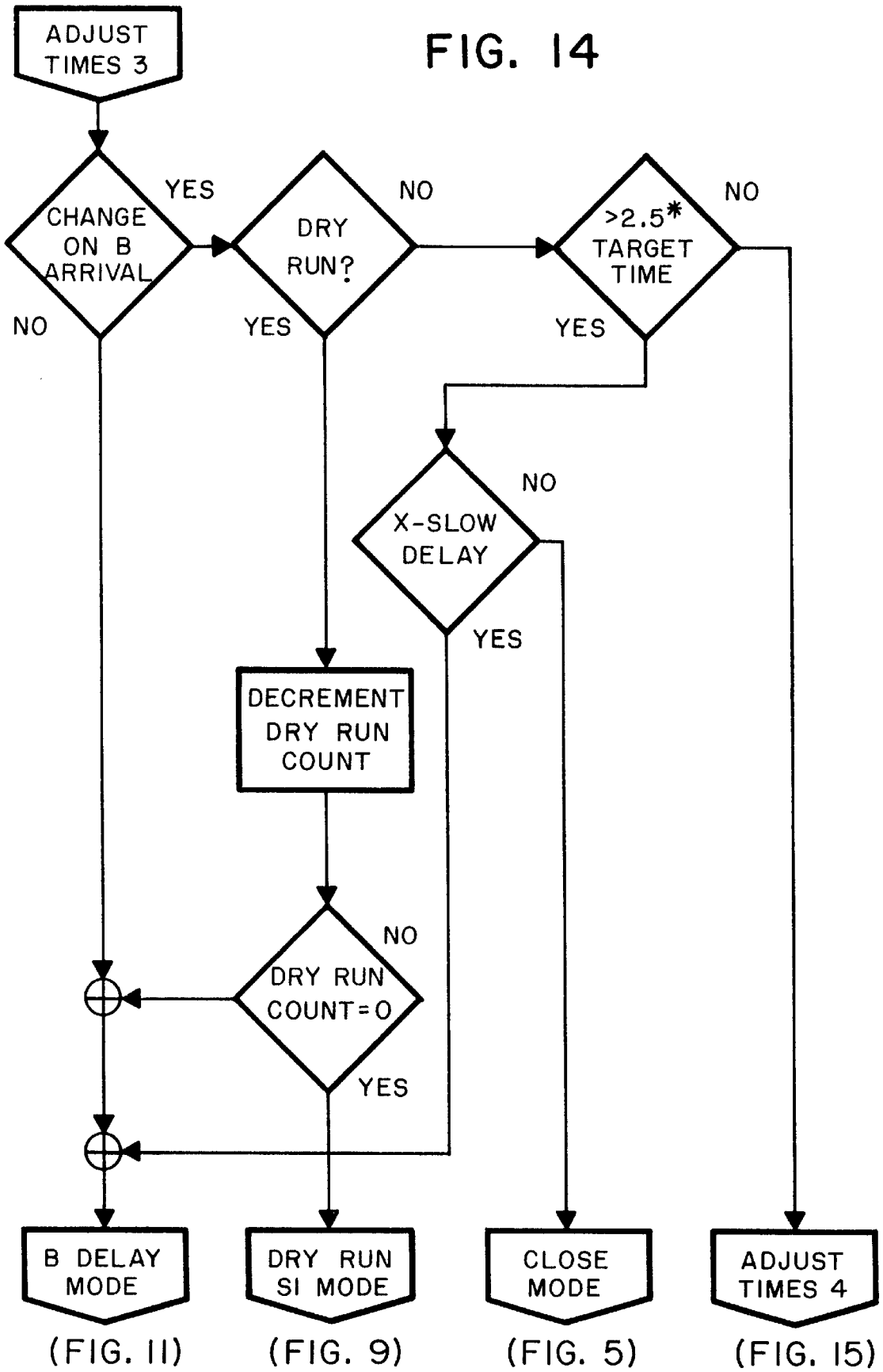

FIG. 7 depicts a B Open Mode wherein initially the A valve 12 is closed and the B valve 14 is opened. If the plunger P is sensed as being "up" before the B Open Time expires or equals zero, then the program goes to an Adjust Times 3 mode (FIG. 14). If the plunger P is not sensed as being "up" when B Open Time expires or equals zero, then the program goes to a Mand SI Mode (FIG. 8).

FIG. 8 depicts a Mand SI Mode in which both A and B valves 12, 14 are closed for a programmed mandatory shut-in time in response to the plunger P not arriving at the surface within both A and B Open Times. Once the mandatory shut-in time expires or equals zero the program returns to the A Open Mode (FIG. 6).

FIG. 9 depicts a Dry Run SI Mode in which both A and B valves 12, 14 are closed for a programmed dry run shut-in time in response to the plunger P arriving so quickly that there is likely to be no liquid in the tubing string T. Once the dry run shut-in time expires or equals zero the program returns to the A Open Mode (FIG. 6).

FIG. 10 depicts an A Delay Mode in which the B valve 14 is closed and the A valve 12 is maintained open and the plunger P is maintained up for the programmed A Delay Time to prolong sale of gas. Once the A Delay Time expires or equals zero the program returns to the Close Mode (FIG. 5).

FIG. 11 depicts a B Delay Mode in which the B valve 14 is maintained open for the programmed B Delay time. Once the B Delay Time expires or equals zero the program returns to the A Delay Time (FIG. 10).

FIG. 12 depicts an Adjust Times 1 mode which includes steps for adjusting the Target Time to optimize the Travel Time of the plunger when the actual plunger arrival was within the Target Time, that is, the plunger P came "up" within the originally programmed A Open Time. The Adjust Times 1 mode classifies the Travel Time of the plunger as either Dry Run, a Too-Slow Run or somewhere inbetween. If it is a Dry Run, then the program decrements the Dry Run count and when equal to zero goes to Dry Run Shut-In Mode (FIG. 9). If it is a Too-Slow Run (greater than 2.5 times Target time), then the program goes either to the Close Mode (FIG. 5) or to the A Delay Mode (FIG. 10). If it is inbetween, that is, less than 2.5 time Target Time and greater than Dry Run, then the program goes to the Adjust Times 2 mode (FIG. 13).

Figure 13:
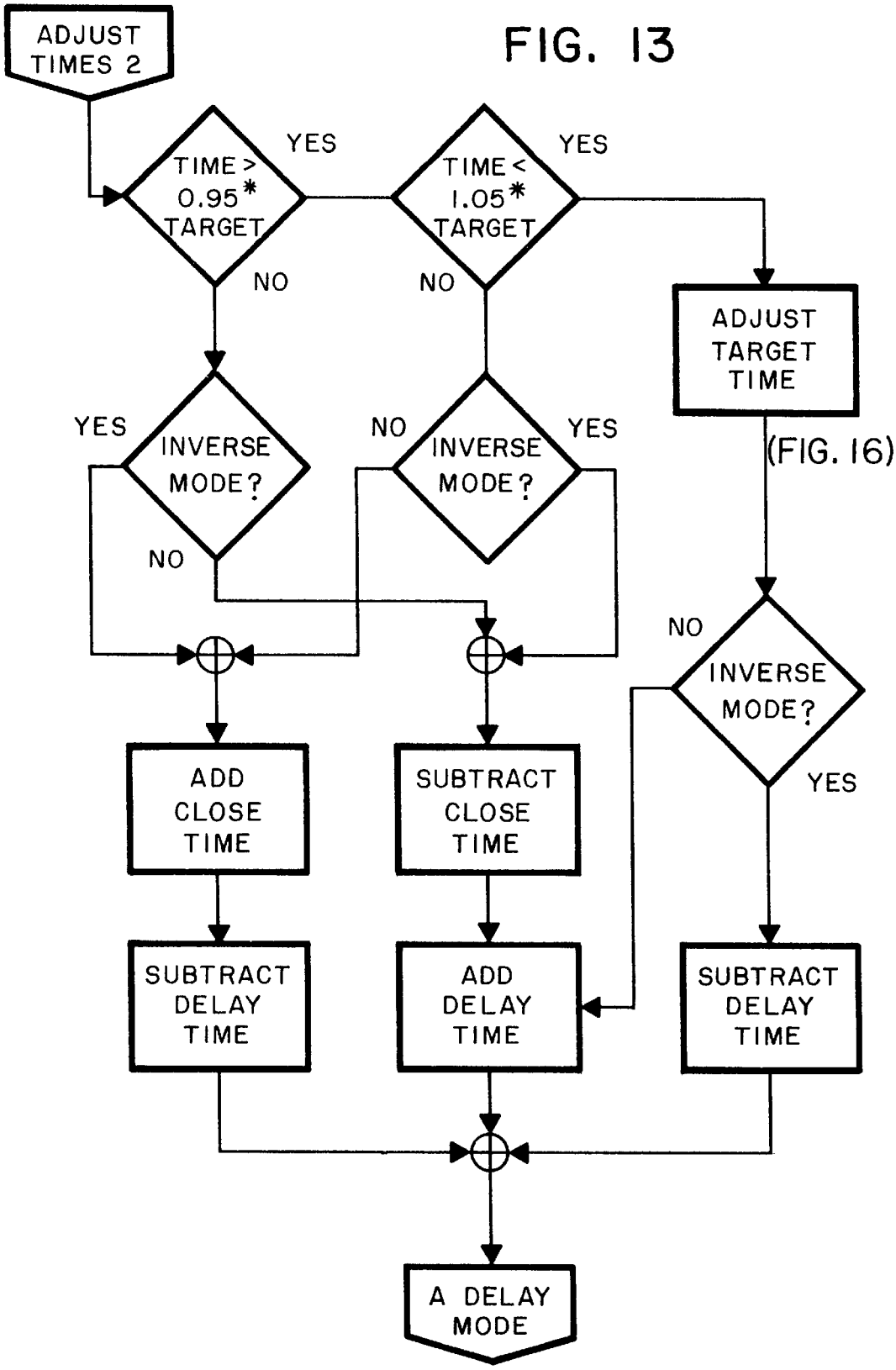

FIG. 13 depicts an Adjust Times 2 mode which includes steps for adjusting the Target Time to optimize the Travel Time of the plunger when the actual plunger arrival was between less than 2.5 times Target Time and greater than Dry Run. The Adjust Times 2 mode classifies the Travel Time of the plunger as either an Optimal Run, Fast Run or Slow Run and responds accordingly before going to the A Delay Mode (FIG. 10). If it is an Optimal Run, then the program goes to Adjust Target Time (FIG. 16) and then returns and either adds or subtracts Delay Time depending upon whether or not the operator has selected the Inverse Mode. If it is a Fast Run (less than 0.95 times Target time), then the program either adds Close Time and subtracts Delay Time or subtracts Close Time and adds Delay Time depending upon whether or not the operator has selected the Inverse Mode. If it is a Slow Run (greater than 1.05 times Target Time), then the program either adds Close Time and subtracts Delay Time or subtracts Close Time and adds Delay Time depending upon whether or not the operator has selected the Inverse Mode.

FIG. 14 depicts an Adjust Times 3 mode which includes steps for adjusting the Target Time to optimize the Travel Time of the plunger when the actual plunger arrival was not within the Target Time, that is, the plunger P came "up" within the originally programmed B Open Time. The Adjust Times 3 mode determines whether or not the Travel Time of the actual plunger arrival is a Change On B Arrival and then if it is not a Change On B Arrival the program goes to B Delay Mode (FIG. 11) and if it is a Change On B Arrival the program classifies the Travel Time of the plunger as either Dry Run or a Too-Slow Run or somewhere inbetween. If it is a Dry Run, then the program decrements the Dry Run count and when equal to zero goes to Dry Run Shut-In Mode (FIG. 9). If it is a Too-Slow Run (greater than 2.5 times Target time), then the program goes either to the Close Mode (FIG. 5) or to the B Delay Mode (FIG. 11). If it is inbetween, that is, less than 2.5 times Target Time and greater than Dry Run, then the program goes to the Adjust Times 4 mode (FIG. 15).

Figure 15:
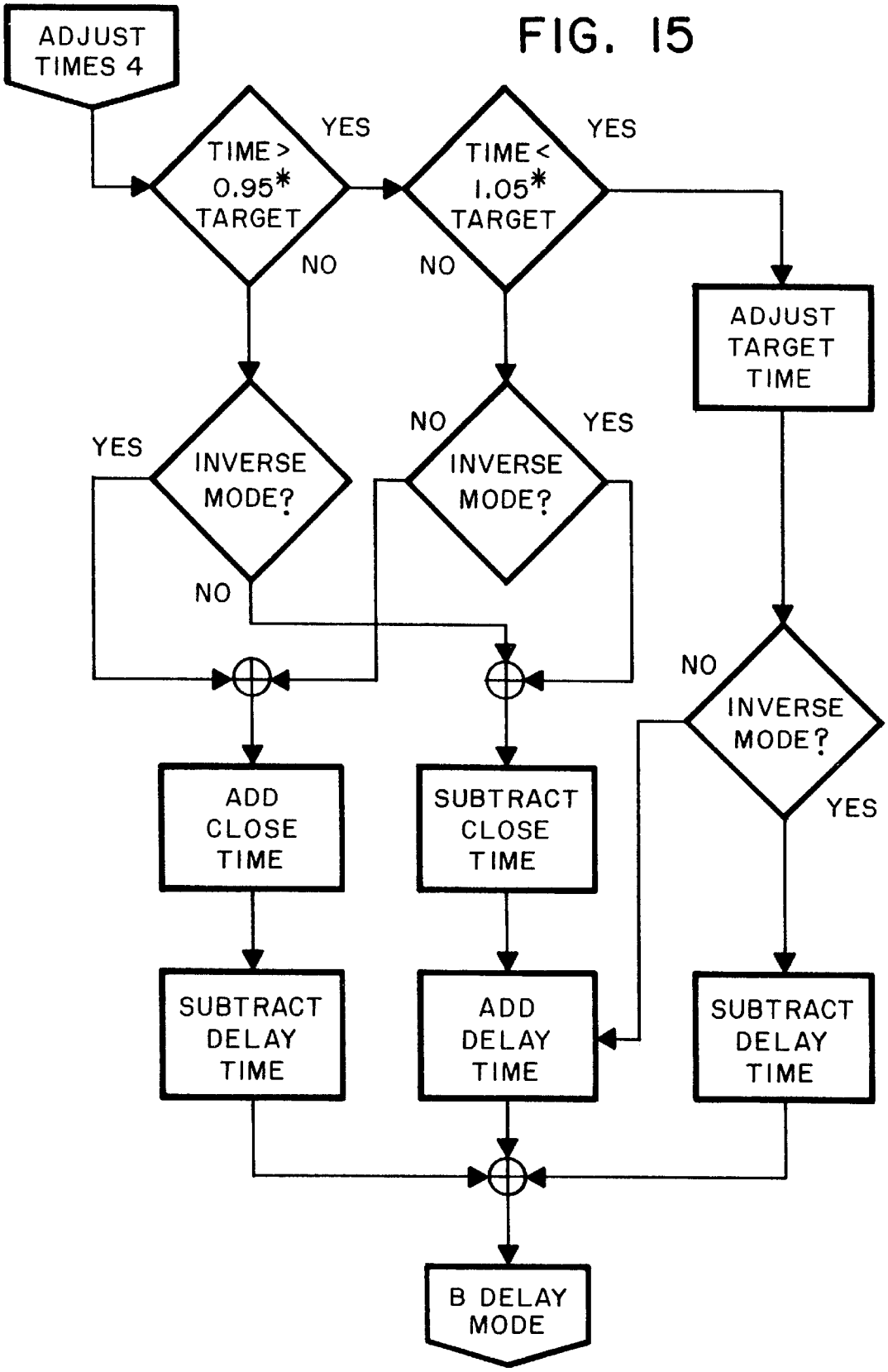

FIG. 15 depicts an Adjust Times 4 mode which includes steps for adjusting the Target Time to optimize the Travel Time of the plunger when the actual plunger arrival was less than 2.5 times Target time and greater than Dry Run. The Adjust Times 4 mode classifies the Travel Time of the plunger arrival as either an Optimal Run, Fast Run or Slow Run and responds accordingly before going to the B Delay Mode (FIG. 11). If it is an Optimal Run, then the program goes to Adjust Target Time (FIG. 16) and then returns and either adds or subtracts Delay Time depending upon whether or not the operator has selected the Inverse Mode. If it is a Fast Run (less than 0.95 times Target time), then the program either adds a fraction of the Target Time to Delay Time and subtracts a fraction of the Target Time from Close Time or subtracts a fraction of the Target Time from Delay Time and adds a fraction of Target Time to Close Time depending upon whether or not the operator has selected the Normal Arithmetic or Inverse Arithmetic mode. If it is a Slow Run (greater than 1.05 times Target time), then the program either subtracts a fraction of Target Time from Delay Time and adds a fraction of Target Time to Close Time or adds a fraction of Target Time to Delay Time and subtracts a fraction of Target Time from Close Time depending upon whether or not the operator has selected the Normal Arithmetic or Inverse Arithmetic mode.

Figure 16:
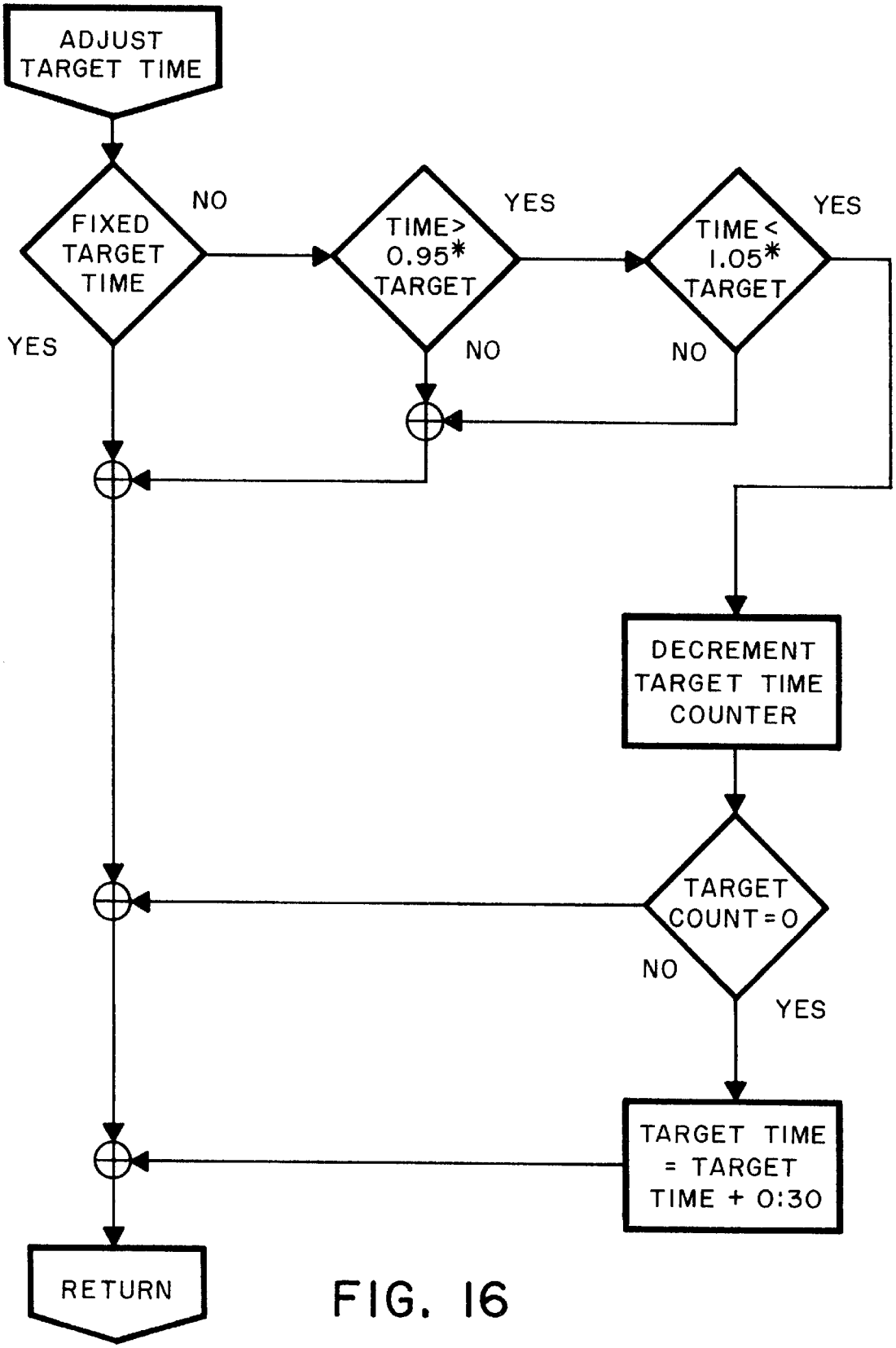

FIG. 16 depicts an Adjust Target Time mode in which the program distinguishes between a Fixed Target Time setting and an Optimal Run. If it is a Fixed Target Time, then the program returns to the previous mode. If it is an Optimal Run, then the program decrements the Target Time Counter and when the counter equals zero thirty seconds is added to the Target Time before the program returns to the previous mode.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A plunger arrival target time adjustment method for use in conjunction with a gas-producing well, a freely movable plunger disposed in the well for traveling vertically relative to the well between a lower initial position and an upper terminal position in response to open and shut-in conditions of the well, a sales line connected in flow communication with the well and containing a gas under a first level of pressure, a vent line connected in flow communication with the well and containing a gas under a second level of pressure less than the first level of pressure of the gas in the sales line, an A valve interposed in the sales line and being convertable between open and close states in which flow of gas is correspondingly allowed and blocked from the well to the sales line, a B valve interposed in the vent line and being convertable between open and close states in which flow of gas is correspondingly allowed and blocked from the well to the vent line, a plunger arrival sensor disposed remote from the lower initial position of the plunger and adjacent to the upper terminal position of the plunger for sensing arrival of the plunger at the upper terminal position, and an electronic controller connected to the plunger arrival sensor and the A and B valves for controlling cycling of the A and B valves between open and close states and thereby the well between open and shut-in conditions in which the plunger is allowed to travel correspondingly upwardly to the upper terminal position and downwardly to the lower initial position and gas to correspondingly flow from the well and elevate in pressure in the well to a level above the first level of pressure of the gas sales line, said plunger arrival target time adjustment method comprising the steps of:

(a) setting times of A valve open and close states;

(b) setting times of B valve open and close states, said time of B valve open state to occur separately from and in succession to said time of A valve open state;

(c) setting a target time for plunger arrival starting with opening of the well upon converting the A valve to said open state and ending with the sensing of arrival of the plunger at the upper terminal position of the well;

(d) measuring travel time of the plunger from said opening of the well to said sensing of plunger arrival irrespective of whether said arrival occurs during the time of A valve open state or the time of B valve open state; and (e) setting a new target time for plunger arrival based on a predetermined relationship of the measured plunger arrival travel time to the previously set plunger arrival target time.

2. The method of claim 1 wherein said predetermined relationship includes incrementing the previously set target time by a preset time interval in response to occurrence of a preset number of plunger arrivals within a preset percentage of the previously set plunger arrival target time.

3. The method of claim 2 wherein said preset time interval is about thirty seconds.

4. The method of claim 2 wherein said preset percentage is about five percent.

5. The method of claim 1 wherein said predetermined relationship includes incrementing the previously set target time by a time interval of about thirty seconds in response to occurrence of a preset number of consecutive measured plunger arrival travel times within about five percent of the previously set target time.

6. The method of claim 1 wherein said predetermined relationship includes shortening the time the A valve is in open state and lengthing the time the A valve is in close state in response to the measured plunger arrival travel time being faster than the previously set plunger arrival target time.

7. The method of claim 6 further comprising the steps of:

setting a maximum allowable change in time the A valve is in open state and a maximum allowable change in time the A valve is in close state such that the amount of time the A valve in open state can be lengthened or shortened is a function of the set maximum allowable changes in the times the A valve is in open and close states and of the difference of the measured plunger arrival travel time from the previously set target time.

8. The method of claim 7 wherein in response to the measured plunger arrival travel time being more than about fifty percent but less than about ninety-five percent of the previously set target time, a fraction of the set maximum allowable change in time the A valve is in open state is added to the previously set time of the A valve open state to provide a new set time of the A valve open state and a fraction of the set maximum allowable change in time the A valve is in close state is subtracted from the set time of the A valve close state to provide a new set time of the A valve close state.

9. The method of claim 7 wherein in response to the measured plunger arrival travel time being more than about ninety-five percent of the previously set target time and less than about one hundred five percent of the previously set target time, about five percent of the set maximum allowable change in time the A valve is in open state is added to the set time of the A valve open state to provide a new set time of the A valve open state and no change is made to the set time of the A valve close state.

10. The method of claim 1 wherein said predetermined relationship includes lengthening the time the A valve is in open state and shortening the time the A valve is in close state in response to the measured plunger arrival travel time being slower than the previously set plunger arrival target time.

11. The method of claim 10 further comprising the steps of:

setting a maximum allowable change in the time the A valve is in open state and a maximum allowable change in the time the A valve is in close state such that the amount of time the A valve in open state can be lengthened or shortened is a function of the set maximum allowable changes in the times the A valve is in open and close states and of the difference of the measured plunger arrival travel time from the previously set target time.

12. The method of claim 11 wherein in response to the measured plunger arrival travel time being more than about one hundred five percent but less than about two hundred percent of the previously set target time, a fraction of the set maximum allowable change in time the A valve is in open state is subtracted from the previously set time of the A valve open state to provide a new set time of the A valve open state and a fraction of the set maximum allowable change in time the A valve is in close state is added to the set time of the A valve close state to provide a new set time of the A valve close state.

13. The method of claim 11 wherein in response to the measured plunger arrival travel time being more than about ninety-five percent of the previously set target time and less than about one hundred five percent of the previously set target time, about five percent of the set maximum allowable change in time the A valve is in open state is added to the set time of the A valve open state to provide a new set time of the A valve open state and no change is made to the set time of the A valve close state.

14. The method of claim 1 wherein in response to the measured plunger arrival travel time being more than about fifty percent but less than about ninety-five percent of the previously set target time, a fraction of a preset maximum allowable change in time the A valve is in open state is added to the previously set time of the A valve open state to provide a new set time of the A valve open state and a fraction of the set maximum allowable change in time the A valve is in close state is subtracted from the set time of the A valve close state to provide a new set time of the A valve close state.

15. The method of claim 1 wherein in response to the measured plunger arrival travel time being more than about ninety-five percent of the previously set target time and less than about one hundred five percent of the previously set target time, about five percent of a preset maximum allowable change in time the A valve is in open state is added to the set time of the A valve open state to provide a new set time of the A valve open state and no change is made to the set time of the A valve close state.

16. The method of claim 1 wherein in response to the measured plunger arrival travel time being more than about one hundred five percent but less than about two hundred percent of the previously set target time, a fraction of a preset maximum allowable change in time the A valve is in open state is subtracted from the previously set time of the A valve open state to provide a new set time of the A valve open state and a fraction of the set maximum allowable change in time the A valve is in close state is added to the set time of the A valve close state to provide a new set time of the A valve close state.

* * * * *